United States Patent [19]

Andis

[11] Patent Number: 4,458,417

[45] Date of Patent: Jul. 10, 1984

[54] HAIR CLIPPER BLADE SET

[75] Inventor: Matthew L. Andis, Racine, Wis.

[73] Assignee: Andis Company, Racine, Wis.

[21] Appl. No.: 402,103

[22] Filed: Jul. 26, 1982

[51] Int. Cl.[3] ..... B26B 19/06

[52] U.S. Cl. ..... 30/216; 30/222

[58] Field of Search ..... 30/221, 222, 223, 224, 30/216, 220

[56] References Cited

U.S. PATENT DOCUMENTS

| | | | |
|---|---|---|---|
| 3,052,025 | 9/1962 | Ring | 30/221 |
| 3,561,116 | 2/1971 | Wahl | 30/221 X |
| 3,747,212 | 7/1973 | Krayl | 30/221 |
| 3,992,778 | 11/1976 | Urbush | 30/216 |
| 4,249,307 | 2/1981 | Andis | 30/216 |
| 4,328,616 | 5/1982 | Andis | 30/216 X |

*Primary Examiner*—Jimmy C. Peters

*Attorney, Agent, or Firm*—Michael, Best & Friedrich

[57] ABSTRACT

A hair clipper blade set including a spring member for supporting a upper blade against a lower blade and for linear movement of the upper blade and the lower blade parallel to their forward edges.

The spring member is comprised of a forward end positionable against the upper surface of the movable upper blade, a rear planar portion parallel to and spaced apart from the upper surface of the lower blade, and means for releasably securing the spring member to the lower blade. The rear planar portion includes an aperture for receiving a tension adjustment screw secured in a threaded bore extending through the upper surface of the lower blade.

6 Claims, 4 Drawing Figures

HAIR CLIPPER BLADE SET

BACKGROUND OF THE INVENTION

The invention relates to hair clippers and to electrically operated hair clippers. More particularly, the invention relates to movable blade assemblies for hair clippers and to means for supporting the movable blade assembly of a hair clipper against the lower blade such that the compression force and surface tension or friction between the movable blade assembly and the lower blade can be readily adjusted by the hair clipper operator.

SUMMARY OF THE INVENTION

The invention provides a hair clipper blade set including a spring member for supporting a upper blade against a lower blade and for linear movement of the upper blade and the lower blade parallel to their forward edges.

The spring member is comprised of a forward end positionable against the upper surface of the movable upper blade, a rear planar portion parallel to and spaced apart from the upper surface of the lower blade, and means for releasably securing the spring member to the lower blade. The rear planar portion includes an aperture for receiving a tension adjustment screw secured in a threaded bore extending through the upper surface of the lower blade.

The invention also provides a hair clipper blade set for a hair clipper, the blade set including a lower blade including a forward edge with a series of teeth extending therealong and an upper surface extending from the forward edge. The hair clipper blade set further includes a movable upper blade including a forward edge with a series of teeth extending there along and an upper surface and a lower planar surface supported on the upper surface of the lower blade. The hair clipper blade set further includes means for supporting and biasing the upper blade against the lower blade and for linear movement of the upper blade and the lower blade parallel to their forward edges. The supporting means includes a spring member comprising of a forward end positionable against the upper surface of the movable upper blade, a forward portion including a rear planar portion parallel to and spaced apart from the upper surface of the lower blade and behind the movable upper blade, a rearward portion, and an offset extending downwardly from the rear planar portion extending parallel to the blades forward edge and connecting the forward portion to the rearward portion. The rear planar portion includes an aperture receiving a tension adjustment screw secured in a threaded bore in the upper surface of the lower blade. The spring member's rearward portion includes means for releasably securing the spring member to the lower blade.

In one embodiment of the invention, the movable upper blade includes a yoke member with spaced apart upwardly extending arms for receiving means for reciprocal linear movement of the upper blade, with the forward end of the spring member positionable on the yoke member.

In one embodiment of this invention the upper surface of the lower blade includes two additional threaded bores and the means for releasably securing the spring member to the lower blade includes a pair of apertures in the rearward portion of the spring member in a line parallel to the forward edge of the spring member. A pair of screws in the apertures secured in the threaded bores releasably secures the spring member to the lower blade.

One of the principal features of the invention is the provision of a blade set including adjustable means for supporting an upper movable blade against a lower blade so that the compression and surface tension or friction between the blades can be adjusted by a hair clipper operator. Adjustable supporting means permits the hair clipper operator to increase the compression force between the blades if the blades are being separated by hairs between their teeth. Likewise, the adjustable supporting means permits the hair clipper operator to reduce the surface tension or friction between the blades to prohibit the overheating of the hair clipper and to limit the wear between the clipper blades.

Other features and advantages of the embodiments of the invention will become known by reference to the following description, to the appended claims, and to the drawings.

Figure 1:
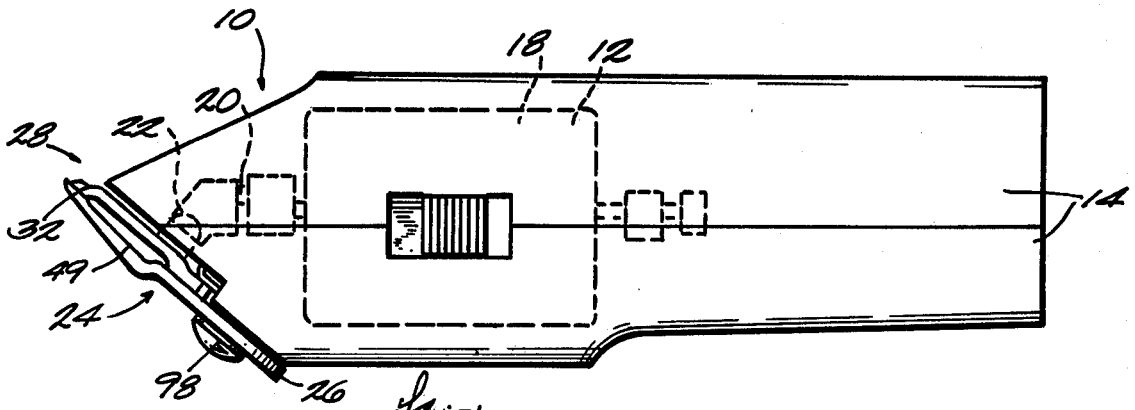
FIG. 1 is a side elevation view of a hair clipper embodying various of the features of the invention.

Before explaining a preferred embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

Shown in the drawings is an electrical hair clipper 10 which embodies various of the features of the invention and which includes a housing 12 which is constructed of electrically insulating material, such as plastic. Any suitable design can be employed and, in the illustrated construction, the housing comprises two sections or parts 14 which are connected together. Located in the housing 12 is an electric motor 18 which can be of various designs but which, preferably, is an alternating current permanent magnet motor. In the specific construction illustrated, the electric motor 18 is generally arranged in the manner disclosed in U.S. Pat. No. 3,992,778, issued Nov. 23, 1976. The electrical motor 18 includes a drive shaft 20 extending from its end, and an eccentric end portion 22 freely rotatable with respect to the drive shaft 20.

Figure 2:
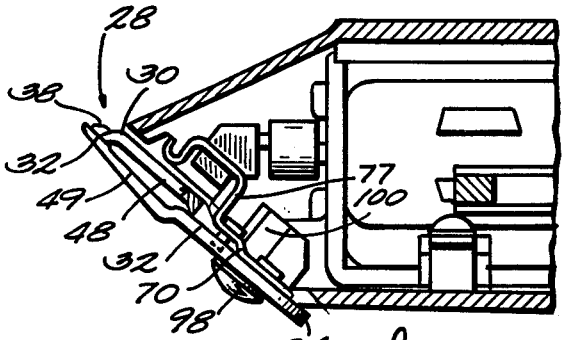
FIG. 2 is an enlarged side elevation view of the blade set and blade set mounting assembly of the hair clipper shown in FIG. 1.
Figure 3:
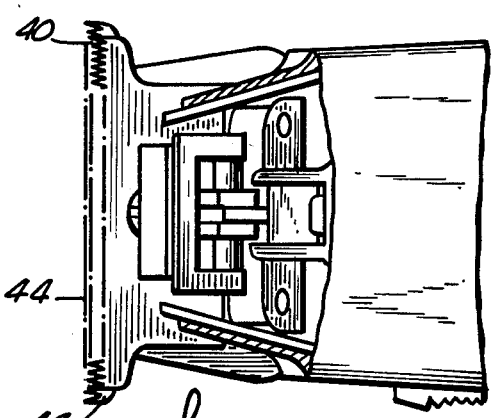
FIG. 3 is an enlarged top plan view showing the movable blade assembly drive arrangement for the blade set incorporated in the hair clipper shown in FIG. 1.
Figure 4:
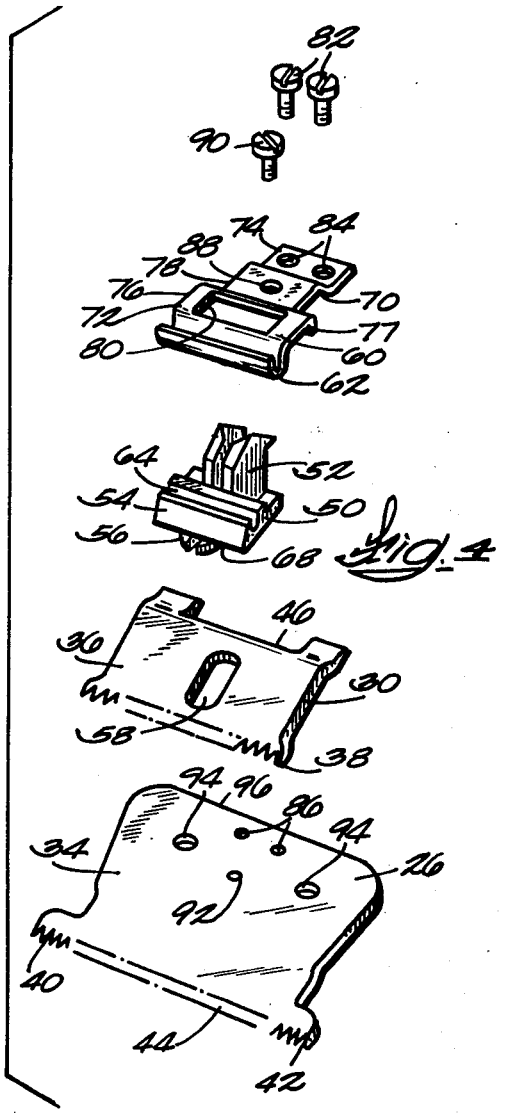
FIG. 4 is an exploded view of the blade set of the hair clipper shown in FIG. 1.

Located at one end of the housing 12 is a blade set 24 which includes a fixed lower blade or shear plate 26 connected to the housing 12 and an upper movable blade, plate or comb assembly 28 reciprocable on and relative to the lower blade 26. In this last regard, the blade set 24 also includes suitable means for guiding reciprocation of the movable blade assembly 28 relative to the lower blade 26. Referring to FIG. 2, the movable blade assembly 28 includes a generally flat planar blade member or plate 30 which includes forwardly and rearwardly co-planar lower surfaces 32 which bear against the upper surfaces 34 of the lower blade 26. The planar blade member 30 also includes an upper surface 36, and a forward edge 38 with a series of teeth 40 (FIG. 3) cooperating with teeth 42 on the forward edge 44 of the lower blade 26.

The movable blade member 30 also includes an indented rearward edge or surface 46 which preferably extends in generally perpendicular relation to the lower and upper surfaces 32 and 36. In the illustrated construction, the lower planar surfaces 32 are separated by a shallow groove 48 parallel to the forward and rearward edges of the movable blade member 30. The upper planar surface 34 of lower blade 26 similarly includes a transverse groove 49. The grooves 48 and 49 function to provide a recess between the lower blade 26 and the movable blade 30 to facilitate mating engagement of the cutting teeth 40 and 42. In an alternative construction, either or both of the grooves 48 and 49 could be deleted.

While the movable blade member 30 can be constructed in various ways, since the movable blade member 30 is planar and relatively thin, it can be conveniently manufactured by machining suitably hardened planar sheet stock.

The movable blade assembly 28 also includes means for engaging the eccentric end portion 22 of the motor drive shaft 20 such that rotation of the motor drive shaft 20 causes reciprocation of the movable blade assembly 28 with respect of the fixed blade 26 and for electrically insulating the movable blade assembly 28 from the motor drive shaft 20.

In this last regard, the movable blade 30 has fixedly extending therefrom an element which is driven by the drive shaft 20 and which is in the form of a yoke member 50 preferably constructed of an electrically insulating material, such as plastic. The yoke member 50 includes a U-shaped portion including first and second laterally spaced arms or walls 52 which extend upwardly from a main portion 54 in overlying engagement with the upper surface 36 of the upper blade 30. The main portion 54 includes a tab 56 located in a recess 58 in the upper blade 30.

Means are further provided for engaging the yoke arms 52 of the yoke member 50 and for causing transverse reciprocating movement of the movable blade assembly 28 to cause relative movement of the teeth 40 and 42. In the illustrated construction, the eccentric end portion 22 attached to the end of the motor drive shaft 20 extends between the yoke arms 52 for engagement therebetween. Rotation of the drive shaft 20 and consequent eccentric movement of the eccentric end portion 22 will thus cause reciprocating movement of the movable blade assembly 28. The eccentric end portion 22 is provided with a conical end such that the eccentric end portion is guided between the yoke arms 52 when the blade set 24 is attached to the housing 12.

Means are further provided for biasing the movable blade assembly 28 against the upper surface 34 of the lower blade 26 and for supporting the movable blade assembly 28 for reciprocating movement in a path generally parallel to the forward edge of the lower blade 26.

In the illustrated construction, such biasing means includes a resilient spring member 60 having a forward linear end or edge portion 62 positioned in a groove 64 in the upper surface 66 of the yoke member 50 of the movable upper blade assembly 28. The groove 64 is adjacent and parallel to the forward edge 68 of the yoke member 50.

The spring member 60 is comprised of thin generally planar spring metal and includes a downwardly extending offset 70 near the rear of the spring member 60. The offset 70 extends parallel to the forward linear edge portion 62. The offset 70 separates the spring member 60 into a forward portion 72 and a planar rearward portion 74. The forward portion 72 includes a front planar portion 76 and a rear planar portion 78. The rear planar portion 78 is parallel to but offset at 77 downwardly from the front planar portion 76. The offset 77 brings the rear planar portion 78 closer to the upper surface 34 of the lower blade 26.

The front planar portion 76 includes an opening 80 to receive the wall portions 52 of the yoke member 50. The opening 80 is large enough to permit reciprocal movement of the wall portions 52 in the opening 80.

The front planar portion 76 of the spring member also includes a downwardly bent edge portion forming the forward linear edge portion 62. The forward linear edge portion 62 is positioned in the groove 64 and is intended to exert a downward force on the yoke member 50 and the movable upper blade and to guide the movable upper blade 30 for reciprocal movement. To facilitate the reciprocal sliding movement of the yoke member 50 with respect to the spring member 60, the forward linear edge portion 62 includes a generally U-shaped edge conforming to the groove 64 in the yoke member 50.

The planar rearward portion 74 includes means for releasably securing the spring member to the lower blade. The securing means comprises two screws 82 received in a pair of apertures 84 in the planar rearward portion 74 in a line parallel to the forward linear edge portion 62 of the spring member 60. The screws 82 are secured in threaded bores 86 extending through the upper surface 34 of the lower blade 26. The securing means permits the easy removal of the removable upper blade assembly and the accurate realignment of the upper blade assembly when the blade set is reassembled.

The rear planar portion 78 of the forward portion 72 includes adjustable means for insuring the spring member 50 is under tension and exerts the appropriate downward force on the yoke member 50 and movable blade 30. This means includes an aperture 88 for receiving a tension adjustment screw 90 secured in a threaded bore 92 in the lower blade 26.

The distance of the forward portion 72 from the forward edge 62 to the rear edge adjacent the offset 70 is longer than the distance of the movable upper blade assembly 28 from the groove 54 to the rear 46 of the movable upper blade 30. As a result, the offset 70 in the spring member 60 is spaced behind the rear edge 46 of the movable upper blade 30. This results in the rear planar portion 78 of the forward portion 72 being behind the movable upper blade 30 and parallel to but spaced apart from the upper surface 34 of the lower blade 26.

The tension adjustment screw 90 can then be screwed or unscrewed so the spacing between the rear planar portion 78 and the upper surface 34 of the lower blade 26 can be increased or decreased. As a result, the hair clipper operator can adjust the amount of downward force exerted by the spring member 60 on the movable blade 30 and thus adjust the surface tension or friction between the upper blade 30 and the lower blade 26.

The apertures 84 and 88 in the spring member 60 are larger than the diameter of the screws 82 and 90 to facilitate adjustment of the position of the spring member 50 and consequent adjustment of the relative position of the movable blade assembly 28 and the lower blade 26.

The blade set 24 and particularly the lower blade 26 is connected to the housing 12 by means permitting the releasable attachment of the blade set 24 on the hair clipper 10. In this embodiment, the connecting means includes a pair of apertures 94 near the rear end 96 of the lower blade 26. Connecting screws 98 are received in the apertures 94 and secured in threaded receiving means 100 connected to the housing 12.

Various of the features of the invention are set forth in the following claims.

1. A hair clipper blade set including a lower blade including a forward edge with a series of teeth extending therealong and an upper surface extending from the forward edge, said upper surface including a threaded bore, a movable upper blade including a forward edge with a series of teeth extending there along, an upper surface, and a lower planar surface supported by said upper surface of said lower blade, and means for supporting and biasing said upper blade against said lower blade and for linear movement of said forward edge of said upper blade parallel to said forward edge of said lower blade, said supporting means including a tension adjustment screw releasably secured in said threaded bore and a spring member comprising a forward portion including a forward end positionable against said upper surface of said movable blade, and a rear planar portion parallel to and spaced apart from said upper surface of said lower blade behind said movable upper blade and having therein an aperture receiving said tension adjustment screw, a rearward portion parallel to said upper surface of said lower blade and including means for releasably securing said spring member to said lower blade, and an offset extending downwardly from said rear planar portion, extending parallel to said forward end and connecting said rear planar portion to said rearward portion.

2. A hair clipper blade set according to claim 1 wherein said movable upper blade includes a yoke member with spaced apart upwardly extending arms for receiving means for reciprocally moving said upper blade, and wherein said forward end of said spring member is positionable on said yoke member.

3. A hair clipper blade set according to claims 1 or 2 wherein said forward portion of said spring member includes a front planar portion connected to said rear planar portion by another downwardly extending offset extending parallel to said forward end so that said rear planar portion is closer to the upper surface of said lower blade than said front planar portion.

4. A hair clipper blade set according to claim 3 wherein said front planar portion includes an opening for receiving the upwardly extending arms of said yoke member.

5. A hair clipper blade set according to claims 1 or 2 wherein said lower blade includes two additional threaded bores extending through said upper surface, and wherein said means for releasably securing said spring member to said lower blade includes a pair of apertures in said rearward portion in a line parallel to said forward edge and a pair of screws in said apertures and secured in said threaded bores.

6. A hair clipper blade set according to claim 5 wherein said apertures in said rearward portion are larger than said pair of screws in said apertures, and wherein said aperture in said rear planar portion is larger than said tension adjustment screw received in said aperture so that the position of the teeth of the upper blade relative to the teeth of the lower blade can be adjusted.

* * * * *